United States Patent [19]

Geibel

[11] 4,271,637

[45] Jun. 9, 1981

[54] SURFACE GRINDING MACHINE

[75] Inventor: Horst Geibel, Homberg/Ohm, Fed. Rep. of Germany

[73] Assignee: Elb-Werkzeug-und Maschinenbau GmbH, Fed. Rep. of Germany

[21] Appl. No.: 50,452

[22] Filed: Jun. 20, 1979

Related U.S. Application Data

[63] Continuation-in-part of Ser. No. 890,133, Mar. 27, 1978, abandoned.

[51] Int. Cl.[3] ..... B24B 7/02

[52] U.S. Cl. ..... 51/92 R; 51/165.77; 51/165.86

[58] Field of Search ..... 51/92 R, 231, 165.78, 51/165.86, 165.77; 318/282, 467, 626

[56] References Cited

U.S. PATENT DOCUMENTS

| | | | |
|---|---|---|---|
| 2,340,096 | 1/1944 | Woodbury et al. | 51/92 R |
| 2,370,701 | 3/1945 | Woodbury | 51/92 R |
| 2,416,861 | 3/1947 | Woodbury | 51/92 R |
| 2,997,815 | 8/1961 | Guinn | 51/92 R |
| 3,073,072 | 1/1963 | Selby | 51/92 R |
| 3,149,439 | 9/1964 | Beattie et al. | 51/92 R |
| 3,247,733 | 4/1966 | Davis | 51/92 R |
| 3,803,770 | 4/1974 | Abraham, Jr. | 51/165.78 |
| 3,938,016 | 2/1976 | Lange et al. | 318/467 |

FOREIGN PATENT DOCUMENTS

| | | | |
|---|---|---|---|
| 2249220 | 4/1973 | Fed. Rep. of Germany | 318/467 |
| 2645074 | 4/1978 | Fed. Rep. of Germany | 51/92 R |
| 467812 | 5/1975 | U.S.S.R. | 51/92 R |

*Primary Examiner*—Harold D. Whitehead
*Assistant Examiner*—K. Bradford Adolphson
*Attorney, Agent, or Firm*—Mandeville and Schweitzer

[57] ABSTRACT

A surface grinding machine is provided which comprises a head, a grinding wheel supported by the head, and a reciprocable bench for receiving and supporting a work piece. A toothed belt has opposite ends thereof fixed to the bench for effecting reciprocation thereof. The belt is guided by guide rollers mounted on the machine frame which deflect the belt to a drive pinion, which is driven by means of a thyristor-controlled reversible permanent magnetic field servomotor. The servomotor is controlled by a single control switch arranged approximately in the middle of the path of travel of the bench. The control switch operates a contactless trigger element which is connected to the servomotor.

5 Claims, 2 Drawing Figures

SURFACE GRINDING MACHINE

RELATED APPLICATION

The present application is a continuation-in-part of Application Ser. No. 890,133, filed Mar. 27, 1978, now abondoned.

BACKGROUND AND DESCRIPTION OF THE INVENTION

The invention relates to a surface grinding machine which has a bench for receiving work pieces, and which is reciprocable relative to a head supporting the grinding wheel by means of a drive.

In machines of this type, it is known to drive the bench hydraulically or electromechanically. When an electromechanical drive is used, the drive from an electric motor is maybe transmitted to the bench via a toothed wheel worm gear or a thread roller spindle. These known drives have the disadvantage of having a relatively small range of adjustment, a low maximum speed and too high a minimum speed. Furthermore, it is not possible to regulate the speed accurately at lower grinding speeds. In addition, the relatively large amounts of noise made by these drives is unpleasant, and servicing is difficult, particularly in the regions where the movable bench reverses. More importantly, the reciprocation requires the use of several interacting switches which, in turn, require substantial control elements. The object of the invention is to overcome these disadvantages and to provide a surface grinding machine which operates reliably even at relatively high and at low grinding speeds, with a simple control arrangement. According to the invention, there is provided a surface grinding machine comprising a head, a grinding wheel supported by the head, a reciprocating bench for receiving and supporting a work piece, a toothed belt having opposite ends thereof fixed to the bench for effecting reciprocation thereof; guide rollers mounted on the machine frame for guiding the toothed belt to a drive pinion, drive means comprising a thyristor-controlled reversible permanent magnetic field servomotor for driving said pinion, and a single control switch for controlling the said drive means, and arranged approximately in the middle of the path of travel of the bench. Two other switches, one at each end of the extent of reciprocation are safety switches, which operate in the event of a malfunction causing reciprocation to the end of travel of the bench.

A reversible permanent magnetic field servomotor drives, via transmission gearing, the toothed belt. It is controlled by the control switch.

A surface grinding machine provided with such a drive mechanism has the advantage, particularly over surface grinding machines with a hydraulic drive, of a greater range of speed adjustment. The range of adjustment can be at least 1000:1, and in some cases, even 5000:1. Other advantages are that the low grinding speed is better and more uniform, being as low as 6 mm per minute, and as high as 50 meters per minute. The lowest grinding speed may even be reduced to below 6 mm per minute, if necessary. With known surface grinding machines, speeds of from 150 mm to a minimum of 30 mm per minute may usually be obtained only with a separate crawling circuit.

Other advantages of the invention are an improved regulation of speed at low grinding speeds, almost noiseless drive, high reliability, and the fact that the drive requires almost no servicing. It is generally sufficient to check or exchange the brushes in the drive motor once a year. Servicing is also simple and convenient, since only one potentiometer is required for the grinding path and another potentiometer for the grinding speed.

The drive motor is a permanent magnetic field servomotor, preferably with eight poles and a built-in tachogenerator. The moment of inertia of this motor is very high in relation to the external moment of inertia, with the result that the machine reaches speed in a very short period of time without over-shooting. The drive motor is controlled by means of a two-pulse thyristor amplifier to which power is supplied from the power system by means of a single phase transformer. The thyristor amplifier is designed in such a way that the face grinding machine is controlled by means of a single control switch. Two other safety switches are imposed in the system for defining ends of the path of the grinding machine bench. The actual control switch is mounted in the middle of that path. The grinding path is, therefore, regulated by a potentiometer while the grinding speed is regulated by a second potentiometer. The motor is not started or stopped jerkily but by means of an adjustable phase in, such as with delayed starting and stopping. In order to avoid thermal overloading of the motor and of the surface grinding machine, the delay should not be too short.

With the drive mechanism used in the invention, the rotational movement of the drive motor is translated simply in a linear movement of the bench supporting the work pieces by means of the toothed belt engaging a toothed wheel mounted on transmission gearing connection to the drive motor.

The surface grinding machine according to the invention may be used for pendulum grinding at maximum bench speeds of up to 50 meters per minute, and optionally higher, and also for crawling grinding at the minimum speeds of, for example, 6 mm per minute or even lower. This wide range of adjustment cannot be obtained with known surface grinding machines.

DETAILED DESCRIPTION OF A PREFERRED EMBODIMENT

Figure 1:
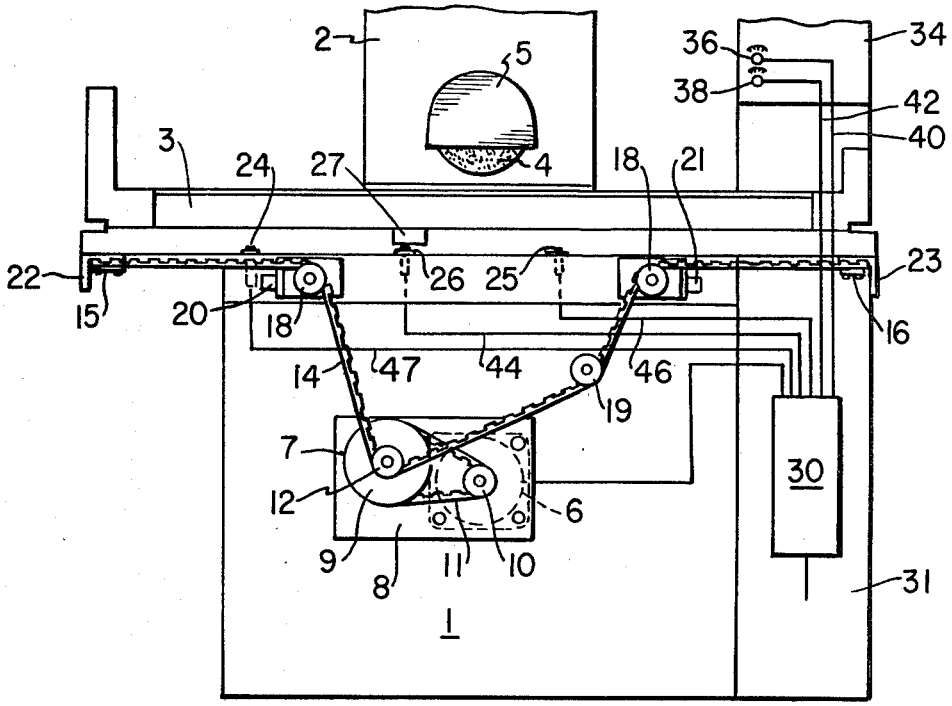
FIG. 1 is a somewhat diagrammatic front elevational view of an embodiment of surface grinding machine according to the invention.

The face grinding machine shown in the drawings has a fixed head 2 on a base frame 1 and a reciprocable bench 3. Work pieces may be fixed on the bench 3 in the conventional way (not shown in detail). A grinding wheel 4 is mounted on the head 2, the upper portion thereof being shielded by a hood 5. The wheel 4 is rotatable by means of a drive mechanism (not shown).

The drive mechanism for the bench 3 is mounted in the base frame 1. This comprises a drive motor 6, which may be an eight-pole permanent magnetic field servomotor with a built-in tachogenerator, and transmission gearing 7, both of which are fixed on a plate 8. The transmission gearing 7 includes a toothed wheel 9 rotatably mounted on plate 8, a pinion 10 mounted on the drive shaft of the motor 6 and an endless toothed belt 11 connecting wheel 9 to pinion 10.

Figure 2:
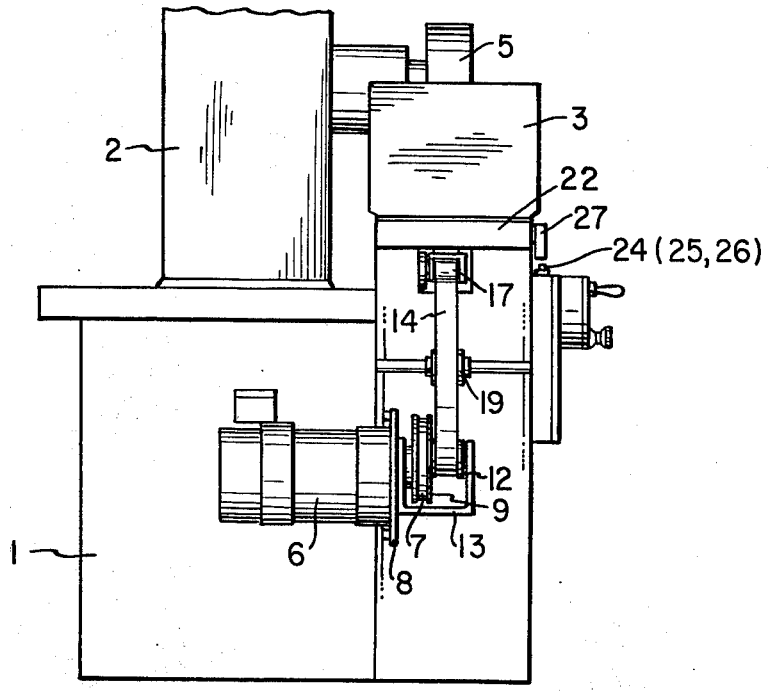
FIG. 2 is a side elevational view of the face grinding machine of FIG. 1, taken from the left-hand side thereof.

Another pinion 12 is provided coaxially to the toothed wheel 9. The pinion 12 is rotatably fixed to the toothed wheel 9 and is mounted with the toothed wheel 9 in a fork 13 (FIG. 2) secured to the face of the plate 8. A toothed belt 14 with the ends 15 and 16 thereof fixed to the underside of bench 3, adjacent the outer ends thereof, engages pinion 12. The toothed belt 14 is guided by means of deflecting rollers 17 and 18 mounted on fixed points of the base frame 1 and an adjustably mounted tension roller 19. The toothed belt 14 is guided flat in its outer regions and deflected between the deflecting rollers 17 and 18 to the drive mechanism, the tension roller 19 providing the required tension in the toothed belt 14.

Rubber springs 20, 21 pointing outwards are fixed on the base frame 1 in the region of the deflecting rollers 17, 18, respectively. The rubber springs act as end position buffers for the reciprocating bench 3, through engagement by flanges 22, 23, respectively, which project from the underside of the bench 3 to form end stops each of which comes into contact with a respective one of the rubber springs 20 or 21 when the bench 3 has reached its respective end position, and has not yet reversed its direction of travel.

A single contactless limit switch 26 is provided on the base frame 1 for reversing the traveling movements of bench 3. The switch 26 emits a reversing signal to the drive mechanism as soon as contact 27 faces it.

The reversing signal may be delayed by a potentiometer 38 until the contact cam 27 with the bench 3 has traveled half of the desired path of travel via the limit switch 26 to the left or to the right, and the bench 3 is then driven back in the opposite direction. Potentiometer 38 may be adjusted, as will be understood, to establish a desired delay period, depending upon the length of reciprocation desired for bench 3. Thus, once switch 26 is activated by the passage of contact 27, the bench may reverse immediately or continue for a period of time, depending on the setting of potentiometer 38.

Two further safety switches 24 and 25 are provided on the base frame 1, which determine the extreme ends of the path. The limit switches 24 and 25 ensure that the bench 3 does not continue to travel in one or the other direction of travel if a breakdown in the control occurs and contact 27, fixed on the bench 3, passes beyond one of these two safety limit switches 24 and 25.

The speed of grinding is regulated by means of potentiometer 36. Both potentiometers 36 and 38 are mounted in a control panel 34, and are connected respectively via lines 42, and 40 with a drive control 30 mounted in a switchboard control 31. Switchboard control 31 is, in turn, in communication with switch 26 through line 44, and in communication with safety switches 24, 25 through lines 47, 46, respectively.

Potentiometers 36 and 38 may be adjusted relative to each other, so that the movement of bench 3 and the speed of movement thereof are correlated.

I claim:

1. A surface grinding apparatus comprising (a) a head, (b) a grinding wheel mounted on said head, (c) a workpiece-supporting bench reciprocable along a predetermined, reciprocal path relative to said grinding wheel, (d) a reversible drive means, (e) said workpiece-supporting bench being mechanically coupled with said reversible drive means whereby the workpiece-supporting bench is reciprocated by said reversible drive means along side predetermined reciprocal path, the improvement characterized by (f) a single control switch for reversing said reversible drive means to reciprocate said bench, (g) said single control switch being centrally positioned relative to said reciprocal path of said bench, (h) means providing communication between said control switch and said drive means, (i) a single switch actuating means associated with said control switch and mounted on said reciprocable bench, (j) said control switch being operable upon activation by said single switch actuating means to emit a reversing signal through said communication means to said reversible drive means, and (k) adjustable, electrical means in said communication means to delay the reversing signal from said control switch to said reversible drive means, (l) whereby the distance traveled by said bench after actuation of said control switch and before reverse operation of said reversible drive means is varied according to the setting of said adjustable, electrical means.

2. The apparatus of claim 1, further characterized by (a) first and second safety switches positioned at each end of said reciprocal path of said reciprocable bench for preventing said bench from further travel in either direction; and (b) said first and second safety switches positioned in said communication means.

3. The apparatus of claim 1, further characterized by (a) said reversible drive means comprising a thyristor-controlled, reversible, permanent magnetic field servomotor, (b) a driving pinion connected to said servomotor through transmission gearing, (c) a toothed belt including opposite ends connected to said reciprocable bench, (d) said belt passing over said driving pinion.

4. The apparatus of claim 1, further characterized by (a) said electrical delay means comprising an adjustable potentiometer associated with said communication means for varying the resistance in said communication means to delay the reversing signal from said control switch to said drive means, (b) whereby adjustment of said potentiometer will vary the delay period for said reversing signal thereby varying the length of reciprocation for said bench.

5. The apparatus of claim 4, further characterized by (a) said drive means being operable to drive said workpiece-supporting bench at a predetermined speed of travel, (b) a second potentiometer in said communication means for regulating the speed of travel of said bench.

* * * * *